United States Patent [19]

Jensen

[11] 4,340,213

[45] Jul. 20, 1982

[54] PRINT STACKING APPARATUS WITH PRINT DEFLECTING FLAP

[75] Inventor: Gerald A. Jensen, Plymouth, Minn.

[73] Assignee: Pako Corporation, Minneapolis, Minn.

[21] Appl. No.: 101,477

[22] Filed: Dec. 10, 1979

[51] Int. Cl.[3] ..... B65H 31/10

[52] U.S. Cl. ..... 271/219; 271/220

[58] Field of Search ..... 271/220, 219, 217, 221–224, 271/207, 208, 209, 210, 211

[56] References Cited

U.S. PATENT DOCUMENTS 1,928,923 10/1933 Andersen .
2,771,293 11/1956 Guttridge .
4,260,148 4/1981 Diesch et al. ..... 271/220

OTHER PUBLICATIONS

IBM Technical Disclosure Bulletin–vol. 15, No. 7, Dec. 1972, p. 2194.
IBM Technical Disclosure Bulletin–vol. 17, No. 4, Sep. 1974, (p. 1135), Receiving Tray.
IBM Technical Disc., vol. 18, No. 7, Dec. 1975, Variable Size Exit Tray.
IBM Technical Disclosure, vol. 17, No. 5, Oct. 1974, Paper Bin.

*Primary Examiner*—Robert B. Reeves
*Assistant Examiner*—Brian Bond
*Attorney, Agent, or Firm*—Kinney, Lange, Braddock, Westman and Fairbairn

[57] ABSTRACT

A photographic print stacking apparatus is positioned proximate the discharge end of a conveyor system which conveys photographic prints from a photographic print cutter. The print stacking apparatus includes upper and lower print receiving elements which receive and hold the prints as they are discharged. The conveyor system delivers the prints to the stacking apparatus with sufficient force to carry the prints between the upper and lower print receiving elements until their leading edges engage a generally upstanding stop element. A print deflecting flap element is connected to the upper print receiving element and extends toward the stop element. The print deflecting flap element prevents the leading edges of the prints from passing over the upper end of the stop element.

6 Claims, 3 Drawing Figures

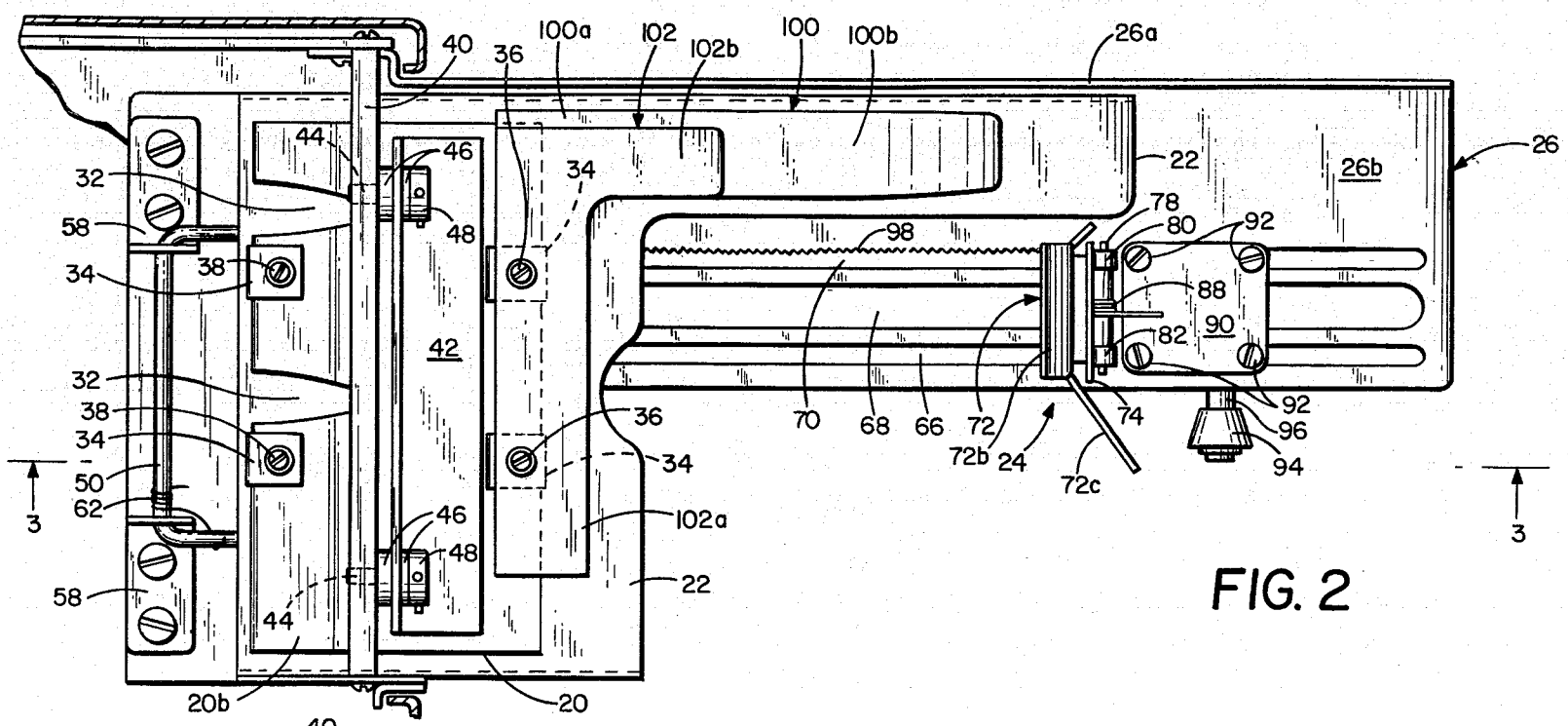
FIG. 2
FIG. 3
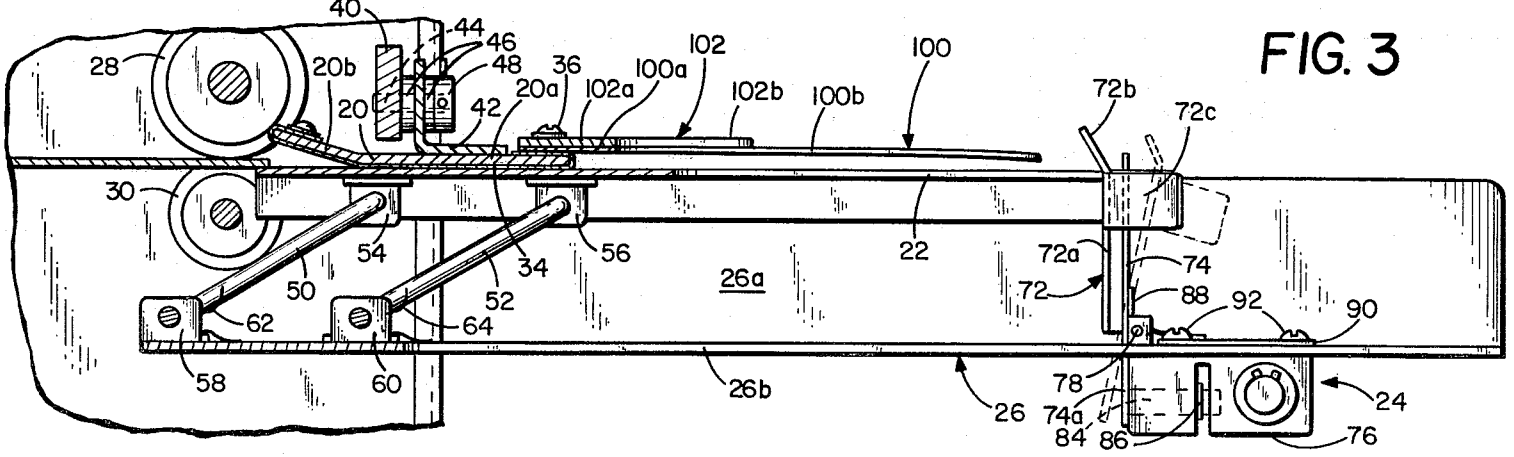

PRINT STACKING APPARATUS WITH PRINT DEFLECTING FLAP

BACKGROUND OF THE INVENTION

1. Field of the Invention

The present invention relates to photographic processing equipment. In particular, the present invention is an improved print stacking apparatus for stacking individually cut photographic prints.

2. Description of the Prior Art

In commercial photographic processing operations, very high rates of processing need to be achieved and maintained in order to operate profitably. To expedite the photographic processing, orders containing film of similar type and size are spliced together for developing. As many as 500 to 1000 rolls of 12, 20, 24 and 36 exposure film may be spliced together for processing and printing purposes.

After developing, the photographic film contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of photographic print paper has been processed to produce prints, a photographic paper cutter cuts individual prints from the strip. The prints are then sorted by customer order, either manually or automatically, and ultimately packaged and sent to the customer.

Automatic print paper cutters have been developed which automatically cut the print paper into individual prints. These automatic paper cutters are controlled by indicia which are placed along the print paper by the photographic printer. Typically the indicia are of two types: cut marks and end-of-order marks. Cut marks indicate the desired location of a cut between adjacent prints. End-of-order marks, which typically appear along the opposite edge of the print paper from the cut marks, indicate the end of a customer's order. The automatic paper cutter includes a sensor which senses the cut marks and causes the individual prints to be cut from the strip at desired locations. The separated prints are passed to an order packaging or grouping device which groups the prints in response to the end-of-order marks which are sensed by the automatic cutter.

The desire for higher rates of processing within commercial photographic processing operations has led to the development of extremely high speed automatic paper cutters. One example of such an automatic paper cutter is described in U.S. Pat. No. 4,128,887 by G. Strunc and F. Laciak, which is assigned to the same assignee as the present application. The automatic paper cutter described in this patent is capable of cutting over 25,000 prints per hour (i.e. over seven prints per second).

Print stacking devices have been developed for stacking the photographic prints which have been cut by the photographic paper cutter. In some cases, these print stacking devices have been an attachment or addition to a photographic paper cutter, while in other cases the print stacking device has been part of an automatic print sorter. In general, these prior art print stacking devices have included means for conveying the photographic print from the paper cutter and depositing the print into an open box or container. The prints are deposited generally one on top of the other to form the stack of prints.

These prior art print stacking devices, however, have not been entirely successful. It has proved difficult to produce a print stacking device which yields uniform stacks of prints which can be quickly and easily handled. Instead, the operator has often been required to rearrange the prints, such as by standing a stack of prints on edge on a flat surface and tapping the prints to align their edges prior to insertion of the prints into a pocket of the customer order envelope. This procedure, of course, is time-consuming and reduces the overall efficiency of handling the photographic prints.

One particularly advantageous print stacking device is shown in U.S. patent application Ser. No. 21,091 filed Mar. 16, 1979 by Robert E. Diesch and Charles L. Eutenuer, which is assigned to the same assignee as the present application. In this device, upper and lower print receiving elements are positioned proximate the discharge end of a conveyor system which conveys photographic prints from a photographic print cutter. The upper print receiving element is preferably a floating foot element. The lower print receiving element, which is preferably a print supporting platform, is movable generally downward and away from the upper print receiving element as the prints are deposited on the lower print receiving element. The conveyor system delivers the prints with sufficient force to carry the prints between the upper and lower print receiving elements until their leading edges engage a stop element which is preferably connected to a base element located below the lower print receiving element.

SUMMARY OF THE INVENTION

The present invention is an improvement to a photographic print stacking device of the type generally shown in the previously mentioned Diesch and Eutenuer patent application. The present invention overcomes a difficulty which has been encountered in some cases due to the curling of photographic prints.

In particular, photographic print paper which has been processed is typically wound into a sizable roll. This roll is then mounted on the paper supply of the photographic print cutter, and the print paper is withdrawn from the roll as the prints are cut.

The storage of the photographic print paper in a roll tends to cause the paper to curl. Prints from the outermost part of the roll will exhibit the least amount of curl, while prints cut from the innermost part of the roll (i.e. the last print to be cut) will exhibit greater curl.

The problems of curl of the print through a print cutter and a print conveyor system have been overcome by positively driving the prints at all times. As the prints are deposited onto the print stacking device, however, positive drive of the prints is ended.

The problem which has been encountered in the print stacking device of the Diesch and Eutenuer patent application is caused by prints with extremely large amounts of curl. As a curled print is driven between the first and second print receiving elements, the leading edge of the print begins to rise with respect to the trailing edge, since the leading edge is not held, while the trailing edge is held between the upper and lower print receiving elements. Since the prints are curled concave downward, it is my theory that an airfoil effect causes the rising of the leading edge. Other factors, such as the fact that the prints are being driven by drive rollers on their top surfaces may also contribute to this effect. In some cases in the prior art, the leading edge of a curled print has passed over the top of the stop element, so that the forward travel of the print is not stopped. Since the prints were not stacked correctly, they had to be gathered together which caused lost production time.

The present invention is an improved print stacking apparatus which overcomes the problems caused by prints with excessive curl. The print stacking apparatus of the present invention includes upper and lower print receiving elements, which receive and hold the prints as they are discharged. A print deflecting means is connected to the upper print receiving element and extends generally parallel to the lower print receiving element and toward the upstanding stop means. The deflecting means deflects the leading edges of the photographic prints toward the stop means, to prevent the leading edges from passing above the upper end of the stop means. As a result, the problem of curled prints passing over the top of the stop means is eliminated.

BRIEF DESCRIPTION OF THE DRAWINGS

FIG. 2 is a top plan view showing the improved print stacking apparatus of the present invention.

FIG. 3 is a front sectional view of the improved print stacking apparatus of the present invention.

DETAILED DESCRIPTION OF THE PREFERRED EMBODIMENTS

Figure 1:
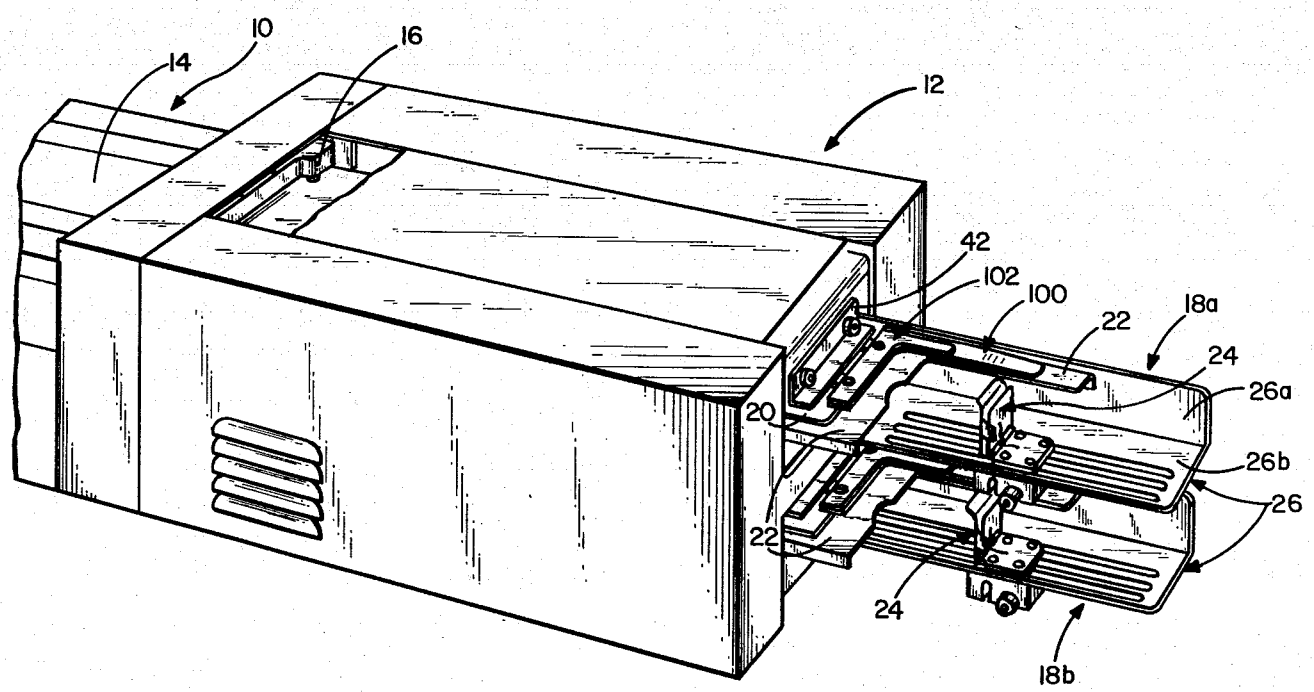
FIG. 1 is a perspective view of a photographic print sorter utilizing the improved photographic print stacking apparatus of the present invention.

In the following description, the improved print stacking device of the present invention will be shown in use in conjunction with a photographic print sorter, in which photographic prints are sorted into good, remake and reject prints. It should be understood, however, that the improved print stacking device of the present invention may also be used in systems in which the photographic prints are not sorted into various groups, but rather are merely grouped by customer order.

FIG. 1 shows a photographic print cutting and sorting system which includes a photographic print cutter 10 and a print sorter 12. Photographic print cutter 10 may be, for example, an automatic photographic paper cutter such as the Pako PC305 paper cutter, which is described in the previously mentioned U.S. Pat. No. 4,128,887 by G. Strunc and F. Laciak, and which is assigned to the same assignee as the present invention.

Photographic prints are cut from strip 14 by knife assembly 16 of print cutter 10. The cut prints are sorted by print sorter 12 into good, remake and reject prints. This sorting is done on the basis of remake and reject indicia which have been previously applied to the face of remake and reject prints. The indicia are sensed by a remake/reject sensor (not shown) which is located on the print cutter 10 near knife assembly 16.

As shown in FIG. 1, print sorter 12 has two print stacking devices of the present invention: good print stacker 18*a* and remake print stacker 18*b*. The "good" prints (which have neither a remake indicium nor a reject indicium) are conveyed by print sorter 12 to good print stacker 18*a*. Remake prints are directed along a different path and conveyed by sorter 12 to remake print stacking assembly 18*b*. The reject prints are driven along still a third path and are either driven out the bottom of sorter 12 and into a wastebasket or the like, or driven and stacked on a third print stacking assembly (not shown).

At the end of each order the operator removes the good and remake prints accumulated at print stacking assemblies 18*a* and 18*b*, respectively, and places the prints into the customer order envelope. The system is then re-started and prints of the next order are sorted and stacked.

As shown in FIG. 1, the good print stacking assembly 18*a* and the remake print stacking assembly 18*b* are identical. For that reason, identical numbers will be used to designate identical elements, and in FIGS. 2 and 3 only one of the two print stacking assemblies will be shown and described.

As shown in the Figures, each print stacking assembly includes upper movable foot element 20, lower print receiving platform element 22, stop element 24, and print tray base 26. Upper foot element 20 has a generally planar portion 20*a* and an upwardly inclined guiding portion 20*b* at its receiving end. The upwardly inclined guiding portion 20*b* acts as a deflector to deflect prints generally downwardly toward platform 22 and onto the top of a stack of prints (not shown) being held between planar portion 20*a* of foot element 20 and the top surface of platform 22. As best shown in FIG. 3, both the deflecting portion 20*b* of foot element 30, and the receiving end of platform 22 are very closely spaced to the discharge end of the conveyor, as defined by drive rollers 28 and idler rollers 30. For clarity rollers 28 and 30 are not shown in FIG. 2. As shown in FIG. 2, V shaped notches 32 in foot element 20 permit the closely spaced positioning of foot element 20 and drive rollers 28 without interference between the front edge of inclined deflector portion 20*b* and drive rollers 28.

In the embodiment shown, two parallel wear strips 34 are mounted on the bottom surface of foot elements 20 and held in place by connectors 36 and 38. Wear strips 34, which are preferably a low friction surface such as nylon or Teflon, minimize friction of the prints against the lower surface of foot element 20. Alternatively, in other embodiments, the lower surface of foot element 20 is a polished stainless steel or other suitable low friction metal surface, and wear strips 34 are not used.

Movable foot element 20 is yieldably connected to mounting bar 40 by mounting angle 42, pins 44, washers 46, and retaining rings 48. Mounting angle 42 has its horizontal portion mounted to the top surface of planar portion 20*a* of foot element 20. Pins 44 are attached to bar 40 and extend through elongated slots (not shown) in the upstanding portion of mounting angle 42 to permit a limited amount of vertical movement of foot element 20. Washers 46 on opposite sides of the upstanding portion of mounting angle 42 and retaining ring 48 limit the horizontal movement of foot element 20 on pins 44. Washers 46 and retaining ring 40 are preferably positioned and selected so that a slight rocking motion of foot element 20 is permitted. Allowing foot element 20 to float permits uniform loading (via wear strips 34) against platform 22, thus ensuring straight travel of prints.

Platform 22 is pivotally mounted on first and second parallel mounting arm assemblies 50 and 52. Mounting brackets 54 pivotally connect the ends of first arm assembly 50 to the bottom of platform 22. Similarly, brackets 56 pivotally connect the ends of second arm assembly 52 to the bottom of platform 22. First arm assembly 50 is also pivotally connected to print tray base 26 by mounting brackets 58, and second arm assembly 52 is pivotally connected to print tray base 26 by mounting brackets 60. Torsion springs 62 and 64 urge arms 50 and 52, and therefore platform 22, upward toward movable foot element 20. The weight of foot element 20 preferably is sufficient to overcome the force of torsion springs 62 and 64 to establish a rest elevation of platform 22 which is slightly below the plane of the discharge end of the conveyor system, as defined by the final drive and idler rollers 28 and 30.

Print tray base 26 is stationary and generally positioned below movable platform 22. Print tray base 26 has an upstanding side wall 26*a* which provides a limit to the lateral movement of the prints in the stacking apparatus. Horizontal portion 26*b* of print tray base 26 has three parallel slots 66, 68 and 70 which guide movable stop element 24.

Movable stop element 24 includes an upstanding stop member 72 having a print stopping portion 72*a*, a slightly inclined top portion 72*b*, and an outwardly extending handle portion 72*c*. Located immediately behind stop member 72 is an upstanding support member 74, to which stop member 72 is mounted. Members 72 and 74 are generally parallel to one another, and, in their normal position, are both essentially vertically oriented.

Mounting block 76 is positioned below film tray base 26, but has two upstanding posts (not shown) which extend upward through slots 66 and 70, respectively, in film tray base 26. Pivot pin 78, which is held by posts 80 and 82, pivotally connects support member 74 with mounting block 76.

The normal position of stop member 72 and support member 74 is in the generally upstanding position in order to stop the travel of the leading edges of the prints as they are deposited between foot element 20 and platform 22. Stop element 72 must be relatively rigid and strong enough to stop the prints without significant movement itself.

In the embodiment shown, stop member 72 is held sufficiently rigid in its upstanding position to stop prints, while also being pivotable (as illustrated in phantom in FIG. 3) to move out of the way when the operator is removing the stacked prints representing a customer order. In the present invention, member 74 has a downwardly extending narrower portion 74*a* which extends downward through opening 68 in base 26. Member 74 is a ferrous material, and downwardly extending portion 74*a* is normally held in vertical position by permanent magnet 84. The strength of magnet 84, which is held in position in mounting block 76 by retaining ring 86 is sufficient to hold stop member 72 and support member 74 in vertical position against the force of a moving print.

When the operator desires to remove the stacked prints, he grasps handle portion 72*c* and pivots members 72 and 74 downward about a pivot axis defined by pivot pin 78. The force applied by the operator to handle 72*c* is sufficient to overcome the magnetic attraction between magnet 84 and downwardly extending portion 74*a* of member 74.

After the prints have been removed, the operator lets go of handle 72*c*, and torsion spring 88 applies a spring force to member 74 which returns it to an upstanding position. In the upstanding position, lower portion 74*a* is again held by the magnetic field from permanent magnet 84. In other words, stop member 72 is normally magnetically latched in an upright position but is pivotable downward out of the way when prints are to be removed. It is also spring loaded so that it returns to the magnetically latched position after the prints have been removed.

Stop element 24 is movable with respect to the discharge end of the conveyor system so that the stacking mechanism can accommodate different length prints. Mounting block 76 of stop element 24 is connected to plate 90 by screws 92, which extend through slot 66 and 70 of tray base 26. Knob 94 is attached to horizontal pin 96, which passes through mounting block 76 and carries vertical locking pin (not shown) which is received in notches 98 along the side of slot 70 in print tray 26. Pin 96 is spring biased to normally urge and hold the vertical locking pin in one of the notches 98 of slot 70. The position of print stop element 24 may be changed by grasping and pulling knob 94. This pulls the vertical locking pin out of engagement with a notch 98 and permits print stop element 24 to be moved freely along the path defined by slotted openings 66, 68 and 70. When the new position of the stop element 24 is reached, knob 94 is released and the vertical locking pin is permitted to come into engagement with another notch 98.

The present invention overcomes the problem which has been incurred in the past of curled prints rising over the top portion 72*b* of stop element 24. As shown in the Figures, the present invention utilizes a deflecting flapper element formed by flapper member 100 and stiffening member 102, which are attached by screws 36 to floating foot element 20. Flapper member 100 is positioned below stiffening member 102 and is of a thin, flexible metal. Flapper member 100 has a connection portion 100*a* which extends across essentially the entire width of floating foot element 20, and a second, narrower deflecting portion 100*b* which extends from first portion 100*a* toward stop element 24 along the rear edge of the assembly. Stiffening member 102 is a thicker, less flexible metal, and has a first portion 102*a* which generally overlies connection portion 100*a* of flapper member 100. It also has a second portion 100*b* which partially overlies deflecting portion 100*b* of flapper member 100. Second portion 102*b*, however, does not extend as far toward stop element 24 as does deflecting portion 100*b* of flapper member 100.

The purpose of the deflecting flapper element of the present invention is to deflect the leading edge of each print downward so as to ensure that even an extremely curled print cannot rise over the top portion 72*b* of stop member 72. As shown best in FIG. 3, flapper member 100 extends generally parallel to platform 22. Both platform 22 and flapper member 100 have their widest sections nearest the discharge end and their narrowest portions extending along the rear side of the apparatus so as to engage or provide support along only the rear side of the prints. The shape of both platform 22 and flapper member 100 is particularly advantageous because it permits stop element 24 to be mounted on tray base 26, rather than on platform 22. In addition, the shape of flapper member 100 and platform 22 permits the operator to grasp the stack of prints on top and below the prints without any inteference from platform 22 or flapper member 100.

In the preferred embodiments shown in the Figures, flapper member 100 is a thin metal sheet which is sufficiently flexible that it can be bent slightly as the prints are being removed so as to limit interference with the prints during removal. On the other hand, flapper member 100 must be of sufficient strength to deflect the leading edges of the prints as they are deposited and be of sufficient strength that it does not permanently bend when the prints are removed. For this purpose, stiffening member 102 is provided. Stiffening member 102 overlies a portion of flapper member 100 and provides sufficient structural strength, while still permitting deflecting portion 100*b* of flapper member 100 to be flexible.

In conclusion, the present invention is an improved print stacking apparatus which produces uniform stacks of photographic prints, even when the prints have substantial curl. The problem of prints passing over the top of the stop element is eliminated by the use of a deflecting flapper element which extends from the floating foot element toward the stop element. In the preferred embodiments shown, the deflecting flapper element has a shape so that it does not interfere with the removal of prints from the print stacking apparatus.

Although the present invention has been described with reference to preferred embodiments, workers skilled in the art will recognize that changes may be made in form and detail without departing from the spirit and scope of the invention.

What is claimed is:

1. In photographic print stacking apparatus having a discharge end from which photographic prints are discharged, the photographic prints having a leading edge and a trailing edge and a front side edge and a rear side edge; first and second print receiving elements positioned proximate the discharge end to receive and hold the prints therebetween; and stop means for stopping prints as they are deposited between the first and second print receiving element, the stop means having an upper edge; the improvement comprising:

deflecting means for deflecting the leading edge of the photographic print toward a portion of the stop means below the upper edge and connected to the first print receiving element and extending generally parallel to and along a rear edge of the second print receiving element from the first print receiving element toward the stop means, wherein the deflecting means includes a stiffening member and a flapper member made of a flexible material, wherein the flapper member is connected to and underlies the stiffening member wherein the stiffening member overlies a sufficient portion of the flapper member to provide sufficient structural strength to the flapper member while still permitting the flapper member to be sufficiently flexible to deflect the leading edge of the photographic print to cause the leading edge to be stopped by the portion of the stop means below the upper edge, wherein the stiffening and flapper members are positioned below the upper edge of the stop means, wherein both members have a narrow width that is sufficient to engage only the rear side edge of the photographic print, and wherein the second print receiving element moves away from the first print receiving element as additional prints are stacked between the first and second print receiving elements.

2. The invention of claim 1 and further comprising:

a base extending parallel to and below the second print receiving element, wherein the stop means comprises a generally upstanding stop member connected to the base.

3. The invention of claim 2 wherein the second print receiving element comprises a platform having a first portion proximate the discharge end which has a width sufficient to support prints across essentially their entire width and having a second portion extending from the first portion toward the stop means, the second portion having a width which is less than the width of the print and being positioned along the rear side of the apparatus; wherein the first print receiving element generally overlies the first portion of the second print receiving element; and wherein the deflecting means has a connection portion connected to the first print receiving element and a narrow deflecting portion generally overlying the second portion of the second print receiving element along a rear edge thereof.

4. In photographic print stacking apparatus having conveying means for conveying photographic prints, the photographic prints having a leading edge and a trailing edge and a front side edge and a rear side edge, the conveying means having a discharge end at which photographic prints are discharged; upper and lower print receiving elements positioned proximate the discharge end to receive and hold prints therebetween, the lower print receiving element being movable generally downward and away from the upper receiving element as prints are deposited on the lower print receiving element; means for yieldable urging the lower print receiving element upward toward the upper print receiving element; and stop means for stopping the leading edges of prints at a selected location as they are deposited in stacked relation on the lower print receiving element with their trailing edges substantially in alignment at a location proximate the discharge end, the stop means having an upper edge; the improvement comprising:

deflecting means for deflecting the leading edges of the prints toward a portion of the stop means below the upper edge and connected to the upper print receiving element and extending generally parallel to and along a rear edge of the lower print receiving element and from the upper print receiving element toward the stop means, wherein the deflecting means includes a stiffening member and a flapper member made of a flexible material, wherein the flapper member is connected to and underlies the stiffening member, wherein the stiffening member overlies a sufficient portion of the flapper member to provide sufficient structural strength to the flapper member while still permitting the flapper member to be sufficiently flexible to deflect the leading edge of the photographic print to cause the leading edge to be stopped by the portion of the stop means below the upper edge, wherein the stiffening and flapper members are positioned below the upper edge of the stop means, wherein both members have a narrow width that is sufficient to engage only the rear side edge of the photographic print, and wherein the second print receiving element moves away from the upper print receiving element as additional prints are stacked between the upper and lower print receiving elements.

5. In a photographic print stacking apparatus for stacking photographic prints having a leading edge and a trailing edge and a front side edge and a rear side edge, the apparatus having first and second print receiving elements positioned to receive and hold the prints therebetween; means for yieldably urging the first and second print receiving elements toward one another; and generally upstanding stop means having an upper edge for engaging the leading edges of the prints and stopping the prints as they are deposited between the first and second print receiving elements; the improvement comprising:

deflecting means for deflecting the leading edge of the photographic prints toward a portion of the stop means below the upper edge and connected to the first print receiving element and extending generally parallel to and along a rear edge of the second print receiving element for preventing the leading edges of the prints from passing over an upper end of the generally upstanding stop means, wherein the deflecting means includes a stiffening member and a flapper member made of a flexible material, wherein the flapper member is connected to and underlies the stiffening member, wherein the stiffening member overlies a sufficient portion of the flapper member for providing sufficient structural strength to the flapper member while still permitting the flapper member to be sufficiently flexible to the deflect the leading edges of the photographic prints to cause the leading edges to be stopped by the portion of the stop means below the upper edge, wherein the stiffening and flapper members are positioned below the upper edge of the stop means and both members have a narrow width sufficient to engage only the rear side edges of the photographic prints, and wherein the second print receiving element moves away from the first print receiving element as additional prints are stacked between the first and second print receiving elements.

6. A photographic print stacking apparatus for stacking photographic prints having a leading edge and a trailing edge and a front side edge and a rear side edge, the apparatus comprising:

conveying means for conveying the photographic prints, the conveying means having a discharge end at which the photographic prints are discharged and defining a delivery plane;

base means positioned below and generally parallel to the delivery plane;

a receiving platform positioned below the delivery plane and extending forwardly from the discharge end of the conveying means and generally parallel to and above the base;

a floating foot element exposed above the platform in generally opposed relation thereto;

means for maintaining the platform in substantially parallel relation to the base;

means for yieldably urging the receiving platform generally upward toward the floating foot element wherein the receiving platform moves away from the floating foot element as additional prints are stacked between the floating foot element and the receiving platform;

stop means connected to the base and extending upward to stop the prints as they are deposited between the floating foot element and the platform; and deflecting means for deflecting the leading edge of the photographic prints toward a portion of the stop means below an upper edge of the stop means and connected to the floating foot element and extending generally parallel to and along a rear edge of the receiving platform and toward the stop means, wherein the deflecting means includes a stiffening member and a flapper member made of a flexible material, wherein the flapper member is connected to and underlies the stiffening member, wherein the stiffening member overlies a sufficient portion of the flapper member to provide sufficient structural strength to the flapper member while still permitting the flapper member to be sufficiently flexible to deflect the leading edges of the photographic prints to cause the leading edges to be stopped by the portion of the stop means below the upper edge, wherein the stiffening and flapper members are positioned below the upper edge of the stop means for preventing the leading edges of the prints from passing above the upper edge of the stop means, and wherein both members have a width sufficient to engage only the rear side edge of the photographic prints.

* * * * *